US008968125B2

(12) United States Patent
Schwenger

(10) Patent No.: US 8,968,125 B2
(45) Date of Patent: Mar. 3, 2015

(54) TENNIS RACKET

(71) Applicant: Head Technology GmbH, Kennelbach (AT)

(72) Inventor: Ralf Schwenger, Weiler-Simmerberg (DE)

(73) Assignee: Head Technology GmbH, Kennelbach (AT)

( * ) Notice: Subject to any disclaimer, the term of this patent is extended or adjusted under 35 U.S.C. 154(b) by 0 days.

(21) Appl. No.: 14/209,767

(22) Filed: Mar. 13, 2014

(65) Prior Publication Data

US 2014/0274495 A1 Sep. 18, 2014

Related U.S. Application Data

(60) Provisional application No. 61/799,555, filed on Mar. 15, 2013.

(51) Int. Cl.
*A63B 49/02* (2006.01)
*A63B 49/10* (2006.01)
(Continued)

(52) U.S. Cl.
CPC ..... *A63B 49/02* (2013.01); *A63B 49/04* (2013.01); *A63B 2049/0217* (2013.01); *A63B 2049/0252* (2013.01)
USPC ..... 473/537

(58) Field of Classification Search
CPC ..... A63B 49/02; A63B 2049/0252
USPC ..... 473/524, 537
See application file for complete search history.

(56) References Cited

U.S. PATENT DOCUMENTS 1,539,019 A 5/1925 Nikonow
3,801,099 A 4/1974 Lair
(Continued)

FOREIGN PATENT DOCUMENTS

DE 3520335 A1 4/1986
DE 100 60 457 A1 4/2002
EP 0 551 483 B1 10/1997

OTHER PUBLICATIONS

Crawford Lindsey, "Racquet Stability and Swingweight", Racquet Tech, Sep. 1999 (2 pages).
(Continued)

*Primary Examiner* — Raleigh W Chiu
(74) *Attorney, Agent, or Firm* — Bookoff McAndrews, PLLC

(57) ABSTRACT

A tennis racket may include a handle with a butt end, and a head configured to support strings. The tennis racket may also include a throat connecting the handle and the head, wherein the racket may have a Power Maneuverability Ratio from about 4500 to about 7915, the Power Maneuverability Ratio governed by the equation: PMR=

$$\frac{(SW)(RW)}{(PUW)},$$

where SW=the moment of inertia in kilogram-centimeters squared of the tennis racket about a swingweight axis that is perpendicular to a longitudinal axis of the tennis racket, parallel to a tennis ball hitting surface contained by the head, and intersecting a point on the handle that is four inches from the butt end along the longitudinal axis, $$RW = SW - \left(\frac{\mathrm{Wt}}{1000}\right)\left(\frac{b}{10} - 10.16\right)^2,$$

Wt=the weight of the racket in grams, b=the distance in millimeters between a center of gravity of the racket to the butt end.

21 Claims, 2 Drawing Sheets

(51) Int. Cl.
*A63B 49/00* (2006.01)
*A63B 49/04* (2006.01)

(56) References Cited

U.S. PATENT DOCUMENTS

| | | | | | |
|---|---|---|---|---|---|
| 4,291,574 | A | | 9/1981 | Frolow | |
| 4,367,874 | A | | 1/1983 | Staub et al. | |
| RE31,419 | E | | 10/1983 | Frolow | |
| 4,690,405 | A | | 9/1987 | Frolow | |
| RE33,372 | E | | 10/1990 | Frolow | |
| 5,110,126 | A | | 5/1992 | Kuebler | |
| 5,219,165 | A | | 6/1993 | Janes et al. | |
| 5,236,197 | A | | 8/1993 | Chen | |
| 5,368,295 | A | | 11/1994 | Severa et al. | |
| 5,374,058 | A | | 12/1994 | Janes et al. | |
| 5,464,210 | A | * | 11/1995 | Davis et al. | 473/537 |
| 6,074,314 | A | | 6/2000 | DeGaris | |
| 6,234,921 | B1 | | 5/2001 | Davis et al. | |
| 6,623,383 | B2 | | 9/2003 | Matsuoka et al. | |
| 7,137,912 | B2 | * | 11/2006 | Ashino et al. | 473/537 |
| 2002/0055403 | A1 | | 5/2002 | McCutchen | |
| 2004/0248677 | A1 | | 12/2004 | Vu | |
| 2005/0192128 | A1 | * | 9/2005 | Takeuchi et al. | 473/520 |
| 2005/0266941 | A1 | * | 12/2005 | Ashino et al. | 473/535 |
| 2011/0136602 | A1 | | 6/2011 | Hsu et al. | |
| 2013/0172134 | A1 | * | 7/2013 | Yamamoto | 473/537 |

OTHER PUBLICATIONS

Crawford Lindsey, "How Impact Location and Twistweight Affect Spin", Tennis Warehouse, Sep. 15, 2011 (14 pages).
Daniel a. Russell, Ph.D., "Swing Weight of a Bat (Why moment-of-inertia matters more than weight)", last modified on Sep. 4, 2008 (4 pages).
Howard Brody et al., "The Physics and Technology of Tennis", chapters 4 and 5, Apr. 1, 2004 (pp. 3750).
Exemplary data relating to prior art rackets, 2 pages.

* cited by examiner

| RACKET | Wt | b | l | SW | RW | TW | PUW | PMR | SPMR | SMR |
|---|---|---|---|---|---|---|---|---|---|---|
| A | 295 | 325 | 685 | 323 | 176 | 11.72 | 9.59 | 5922 | 69426 | 215 |
| B | 295 | 325 | 685 | 321 | 174 | 13.24 | 9.59 | 5818 | 77043 | 240 |
| C | 300 | 300 | 685 | 286 | 168 | 12.60 | 9.00 | 5336 | 67242 | 235 |
| D | 295 | 305 | 685 | 294 | 172 | 11.07 | 9.00 | 5619 | 62174 | 211 |
| E | 255 | 329 | 685 | 282 | 150 | 10.61 | 8.39 | 5047 | 53536 | 190 |
| F | 275 | 354 | 685 | 332 | 157 | 12.44 | 9.74 | 5348 | 66511 | 200 |
| G | 255 | 356 | 685 | 301 | 136 | 12.60 | 9.08 | 4508 | 56812 | 189 |
| H | 300 | 320 | 685 | 310 | 167 | 11.45 | 9.60 | 5390 | 61709 | 199 |
| I | 300 | 300 | 685 | 289 | 171 | 12.25 | 9.00 | 5488 | 67254 | 233 |
| J | 295 | 324 | 685 | 313 | 167 | 14.74 | 9.56 | 5472 | 80662 | 258 |
| K | 295 | 305 | 685 | 284 | 162 | 11.63 | 9.00 | 5112 | 59465 | 209 |
| L | 300 | 300 | 685 | 272 | 154 | 12.25 | 9.00 | 4652 | 57002 | 210 |
| M | 325 | 320 | 685 | 357 | 202 | 12.42 | 10.40 | 6933 | 86104 | 241 |
| N | 348 | 300 | 685 | 364 | 227 | 14.63 | 10.44 | 7915 | 115815 | 318 |
| O | 310 | 310 | 685 | 328 | 193 | 13.99 | 9.61 | 6600 | 92343 | 282 |
| P | 335 | 318 | 685 | 368 | 211 | 15.20 | 10.65 | 7293 | 110847 | 301 |

FIG. 2

TENNIS RACKET

CROSS-REFERENCE TO RELATED APPLICATIONS

This application claims the benefit of priority from U.S. Provisional Application No. 61/799,555, filed on Mar. 15, 2013, the entirety of which is incorporated by reference herein.

TECHNICAL FIELD

The present disclosure is directed to a tennis racket and, more particularly, to a tennis racket having improved playing characteristics.

BACKGROUND OF THE DISCLOSURE

The game of tennis has changed significantly in the past several decades. Presently, tennis balls are struck with more speed and spin, and elite tennis players are physically much stronger than previous generations of players. Additionally, stroke technique and biomechanics have also evolved. As recently as the 1980's, common stroke technique involved players having a fixed wrist during ball contact. However, it is now common for players to have a loose wrist during ball contact so that the wrist acts as an additional pivot point during the stroke. Thus, as compared to several decades ago, players now generate significantly more angular velocity in a given stroke. Further, players also generally rotate the racket about the racket's longitudinal axis during a stroke in order to generate topspin.

Changes to the physical structure of a tennis racket (e.g., size, shape, balance, weight, weight distribution, material) can affect the playing characteristics of that racket. For example, altering the weight distribution within a given racket will affect that racket's comfort, control, and power characteristics. As a result of the changing stroke styles, there is a need for a racket with improved playing characteristics.

SUMMARY

In one aspect, the present disclosure is directed to a tennis racket. The tennis racket may include a handle with a butt end, and a head configured to support strings. The tennis racket may also include a throat connecting the handle and the head, wherein the racket may have a Power Maneuverability Ratio from about 4500 to about 7915, the Power Maneuverability Ratio governed by the equation: PMR=

$$\frac{(SW)(RW)}{(PUW)},$$

where SW=the moment of inertia in kilogram-centimeters squared of the tennis racket about a swingweight axis that is perpendicular to a longitudinal axis of the tennis racket, parallel to a tennis ball hitting surface contained by the head, and intersecting a point on the handle that is four inches from the butt end along the longitudinal axis, $$RW = SW - \left(\frac{\mathrm{Wt}}{1000}\right)\left(\frac{b}{10} - 10.16\right)^2,$$

Wt=the weight of the racket in grams, b=the distance in millimeters between a center of gravity of the racket to the butt end, TW=the moment of inertia of the tennis racket about the longitudinal axis, and PUW=(Wt)(b).

Various examples of the present disclosure may include one or more of the following aspects: wherein a weight of the racket is from about 255 grams to about 348 grams; wherein a balance distance from the butt end to the center of gravity of the racket is from about 300 mm to about 356 mm; further including higher density portions of the head at 3, 9, and 12 o'clock positions; further including a higher density portion of the racket at the butt end; and wherein the head includes a composite material and the higher density portions include rubber.

In another aspect, the present disclosure is directed to a tennis racket. The tennis racket may include a handle with a butt end, and a head configured to support strings. The tennis racket may also include a throat connecting the handle and the head, wherein the racket may have a Stabilized Power Maneuverability Ratio from about 57,000 to about 115,000, the Stabilized Power Maneuverability Ratio governed by the equation:

$$SPMR = \frac{(SW)(RW)(TW)}{(PUW)},$$

where SW=the moment of inertia in kilogram-centimeters squared of the tennis racket about a swingweight axis that is perpendicular to a longitudinal axis of the tennis racket, parallel to a tennis ball hitting surface contained by the head, and intersecting a point on the handle that is four inches from the butt end along the longitudinal axis, $$RW = SW - \left(\frac{\mathrm{Wt}}{1000}\right)\left(\frac{b}{10} - 10.16\right)^2,$$

Wt=the weight of the racket in grams, b=the distance in millimeters between a center of gravity of the racket to the butt end, TW=the moment of inertia of the tennis racket about the longitudinal axis, and PUW=(Wt)(b).

Various examples of the present disclosure may include one or more of the following aspects: wherein a weight of the racket is from about 255 grams to about 348 grams; wherein a balance distance from the butt end to the center of gravity of the racket is from about 300 mm to about 356 mm; further including higher density portions of the head at 3, 9, and 12 o'clock positions; further including a higher density portion of the racket at the butt end; and wherein the head includes a composite material and the higher density portions include rubber.

The present disclosure is directed to a tennis racket. The tennis racket may include a handle with a butt end, and a head configured to support strings. The tennis racket may also include a throat connecting the handle and the head, wherein the racket hay have a Stabilized Maneuverability Ratio from about 211 to about 318, the Stabilized Maneuverability Ratio governed by the equation:

$$SMR = \frac{(RW)(TW)}{(PUW)},$$

$$RW = SW - \left(\frac{\mathrm{Wt}}{1000}\right)\left(\frac{b}{10} - 10.16\right)^2,$$

SW=the moment of inertia in kilogram-centimeters squared of the tennis racket about a swingweight axis that is perpendicular to a longitudinal axis of the tennis racket, parallel to a tennis ball hitting surface contained by the head, and intersecting a point on the handle that is four inches from the butt end along the longitudinal axis, Wt=the weight of the racket in grams, b=the distance in millimeters between a center of gravity of the racket to the butt end, TW=the moment of inertia of the tennis racket about the longitudinal axis, and PUW=(Wt)(b).

Various examples of the present disclosure may include one or more of the following aspects: wherein a weight of the racket is from about 255 grams to about 348 grams; wherein a balance distance from the butt end to the center of gravity of the racket is from about 300 mm to about 356 mm; further including higher density portions of the head at 3, 9, and 12 o'clock positions; further including a higher density portion of the racket at the butt end; and wherein the head includes a composite material and the higher density portions include rubber.

The present disclosure is directed to a tennis racket. The tennis racket may include a handle with a butt end, and a head configured to support strings. The tennis racket may also include a throat connecting the handle and the head, wherein the racket may have a Power Maneuverability Ratio greater than about 4500, the Power Maneuverability Ratio governed by the equation $$PMR = \frac{(SW)(RW)}{(PUW)},$$

where SW=the moment of inertia in kilogram-centimeters squared of the tennis racket about a swingweight axis that is perpendicular to a longitudinal axis of the tennis racket, parallel to a tennis ball hitting surface contained by the head, and intersecting a point on the handle that is four inches from the butt end along the longitudinal axis, $$RW = SW - \left(\frac{Wt}{1000}\right)\left(\frac{b}{10} - 10.16\right)^2,$$

Wt=the weight of the racket in grams, b=the distance in millimeters between a center of gravity of the racket to the butt end, TW=the moment of inertia of the tennis racket about the longitudinal axis, and PUW=(Wt)(b).

Various examples of the present disclosure may include one or more of the following aspects: wherein the Power Maneuverability Ratio is from about 4500 to about 7915; wherein a weight of the racket is from about 255 grams to about 348 grams; wherein a balance distance from the butt end to the center of gravity of the racket is from about 300 mm to about 356 mm; further including higher density portions of the head at 3, 9, and 12 o'clock positions; further including a higher density portion of the racket at the butt end; and wherein the head includes a composite material and the higher density portions include rubber.

In yet another aspect, the present disclosure is directed to a tennis racket. The tennis racket may include a handle with a butt end, and a head configured to support strings. The tennis racket may also include a throat connecting the handle and the head, wherein the racket may have a Stabilized Power Maneuverability Ratio greater than about 57,000, the Stabilized Power Maneuverability Ratio governed by the equation:

$$SPMR = \frac{(SW)(RW)(TW)}{(PUW)},$$

where SW=the moment of inertia in kilogram-centimeters squared of the tennis racket about a swingweight axis that is perpendicular to a longitudinal axis of the tennis racket, parallel to a tennis ball hitting surface contained by the head, and intersecting a point on the handle that is four inches from the butt end along the longitudinal axis, $$RW = SW - \left(\frac{Wt}{1000}\right)\left(\frac{b}{10} - 10.16\right)^2,$$

Wt=the weight of the racket in grams, b=the distance in millimeters between a center of gravity of the racket to the butt end, TW=the moment of inertia of the tennis racket about the longitudinal axis, and PUW=(Wt)(b).

Various examples of the present disclosure may include one or more of the following aspects: wherein the Stabilized Power Maneuverability Ratio is from about 57,000 to about 115,000; wherein a weight of the racket is from about 255 grams to about 348 grams; wherein a balance distance from the butt end to the center of gravity of the racket is from about 300 mm to about 356 mm; further including higher density portions of the head at 3, 9, and 12 o'clock positions; further including a higher density portion of the racket at the butt end; and wherein the head includes a composite material and the higher density portions include rubber.

In yet another aspect, the present disclosure is directed to a tennis racket. The tennis racket may include a handle with a butt end, and a head configured to support strings. The tennis racket may also include a throat connecting the handle and the head, wherein the racket may have a Stabilized Maneuverability Ratio greater than about 211, the Stabilized Maneuverability Ratio governed by the equation:

$$SMR = \frac{(RW)(TW)}{(PUW)},\ RW = SW - \left(\frac{Wt}{1000}\right)\left(\frac{b}{10} - 10.16\right)^2,$$

SW=the moment of inertia in kilogram-centimeters squared of the tennis racket about a swingweight axis that is perpendicular to a longitudinal axis of the tennis racket, parallel to a tennis ball hitting surface contained by the head, and intersecting a point on the handle that is four inches from the butt end along the longitudinal axis, Wt=the weight of the racket in grams, b=the distance in millimeters between a center of gravity of the racket to the butt end, TW=the moment of inertia of the tennis racket about the longitudinal axis, and PUW=(Wt)(b).

Various examples of the present disclosure may include one or more of the following aspects: wherein the Stabilized Maneuverability Ratio is from about 211 to about 318; wherein a weight of the racket is from about 255 grams to about 348 grams; wherein a balance distance from the butt end to the center of gravity of the racket is from about 300 mm to about 356 mm; further including higher density portions of the head at 3, 9, and 12 o'clock positions; further including a higher density portion of the racket at the butt end; wherein the head includes a composite material and the higher density portions include rubber.

BRIEF DESCRIPTION OF THE DRAWINGS

FIG. 2 is a table listing various physical parameters of exemplary tennis rackets in accordance with the disclosure.

DETAILED DESCRIPTION

Figure 1:
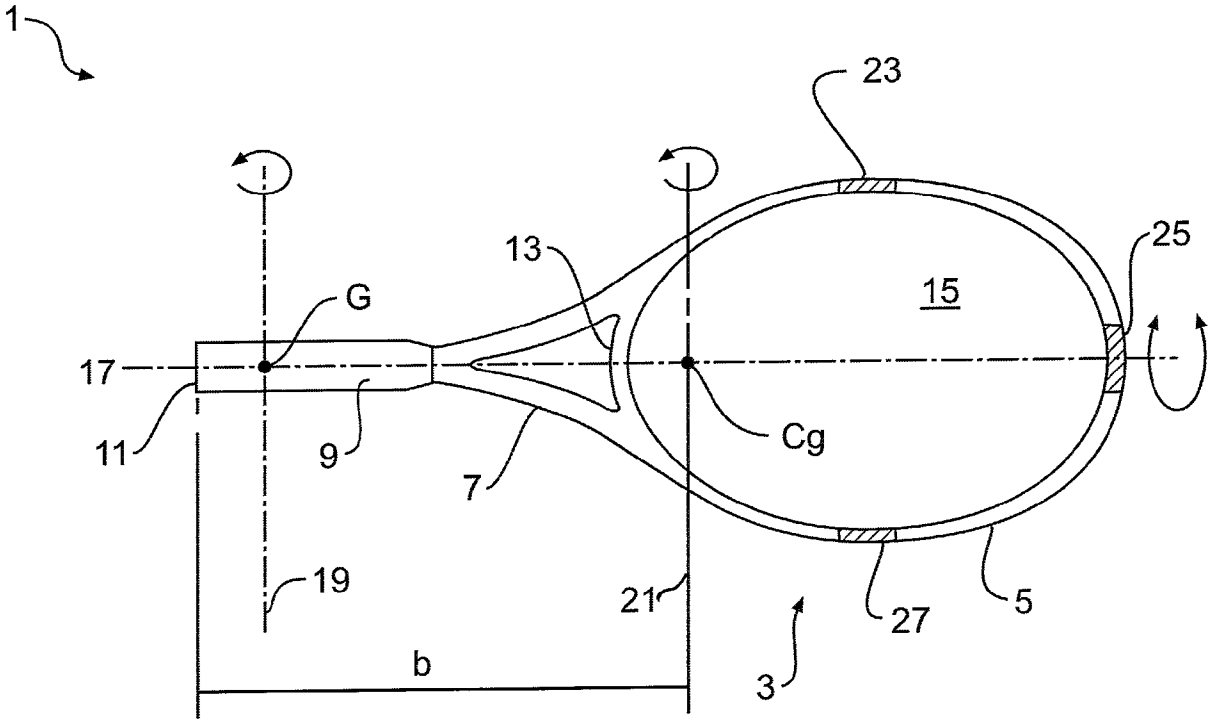
FIG. 1 is a front elevational view of an exemplary disclosed tennis racket.

Reference will now be made in detail to exemplary embodiments of the present disclosure described above and illustrated in the accompanying drawings. Wherever possible, the same reference numbers will be used throughout the drawings to refer to the same or like parts.

According to an embodiment of the present disclosure, a tennis racket 1, shown in FIG. 1, includes a frame 3 having a head 5, a throat 7, and a handle 9. Head 5 may be a closed, oval shape loop, or may alternatively be any other suitable shape. Handle 9 may be connected to a junction of two members of throat 7 and extend toward a butt end 11. The two members of throat 7 may extend from the junction and connect to head 5, and a bridge 13 may connect between the two connection points. It is understood that in certain embodiments, a bridge 13 may be excluded. Head 5 may also generally define a string area 15 that, when strung with a plurality of strings (not shown), forms a tennis ball hitting surface. The head 5 may also include one or more bumper guards and grommet strips (not shown) as is known in the art.

Tennis racket 1 may include a central longitudinal axis 17 that extends along the length direction of the racket from butt end 11 toward an end of head 5. Tennis racket 1 may also include a swingweight axis 19 and a recoilweight axis 21. Swingweight axis 19 may be substantially perpendicular to longitudinal axis 17 and parallel to the direction of the cross strings (not shown), and extend through a point G located on handle 9 about four inches from butt end 11. Recoilweight axis 21 may also be substantially perpendicular to longitudinal axis 17 and extend through a center of gravity $C_g$ of tennis racket 1. Both swingweight axis 19 and recoilweight axis 21 may be parallel or coplanar to the tennis ball hitting surface (or string plane).

Turning to the table of FIG. 2, rows A-P list various physical parameters of exemplary tennis rackets in accordance with the disclosure. These physical parameters correspond to an unstrung racket 1, but otherwise including all of the components of a playable racket, such as handle grip, grommets, and bumper strips.

The listed parameters are as follows:

| | | |
|---|---|---|
| Racket Weight | Wt = | the weight of the racket in grams |
| Balance | b = | distance in millimeters from the center of gravity $C_g$ to butt end 11 |
| Length | I = | the length in millimeters of tennis racket 1 |
| Swing-weight | SW = | the moment of inertia of tennis racket 1 about swing-weight axis 19 in kilogram-centimeters squared, obtained by measuring the moment of inertia about swingweight axis 19 using any suitable diagnostic tool known in the art |
| Recoil-weight | RW = | the moment of inertia of tennis racket 1 about recoilweight axis 21 in kilogram-centimeters squared calculated by the equation: $SW - \left(\frac{Wt}{1000}\right)\left(\frac{b}{10} - 10.16\right)^2$ |
| Twist-weight | TW = | the moment of inertia of tennis racket 1 about longitudinal axis 17 in kilogram-centimeters squared, which may be obtained by the following equation: $254.458\left(\frac{T_c}{\pi}\right) - 8.357,$ where $T_c$ is a center period determined by hanging tennis racket 1 and using a measurement instrument such as a calibrated torsion pendulum or other suitable instrument. It should be noted that the moment of inertia of tennis racket 1 about longitudinal axis 17 may also be calculated in ounce-inches squared by what is known as the trifilar method. According to this method, the racket is oscillated about longitudinal axis 17 with three fibers, each of which has a length of approximately 1.5 meters, are connected to tennis racket 1 from a fixed point above tennis racket 1. Then the oscillation time of the racket is measured and utilized in the following equation $TW = \left(\frac{(Wt)(9.807)(r1)(r2)(t^2)}{((4)(l_1)(\pi^2))}\right),$ where r1 and r2 are the radii of the circles formed by the three aforementioned fibers; ($I_1$) was the length of the fibers, and (t) was the time to complete one oscillation. |
| Pickup-weight | PUW = | the pickup weight of tennis racket 1 in kilogram-centimeters governed by the equation: PUW = (Wt)(b) |
| Power Maneuver-ability Ratio | PMR = | a design factor calculated by the equation: $\frac{(SW)(RW)}{(PUW)}$ |
| Stabilized Power Maneuver-ability Ratio | SPMR = | a design factor calculated by the equation: $\frac{(SW)(RW)(TW)}{(PUW)}$ |
| Stabilized Maneuver-ability Ratio | SMR = | a design factor calculated by the equation: $\frac{(RW)(TW)}{(PUW)}$ |

A tennis racket 1 in accordance with this disclosure may be manufactured by selectively positioning weight about the racket frame 3. According to one example, racket frame 3 may be formed in a conventional manner, such as through the use of a composite of carbon fibers, glass fibers, and epoxy resin, but with additional weight portions at the 3, 9, and 12 o'clock positions, and at the butt end 11 of the racket frame 3. This additional weight can be provided on the racket frame 3 as portions of increased density. For example, as shown in FIG. 1, racket 1 may include portions 27, 23, and 25 of greater density (at the 3, 9, and 12 o'clock positions, respectively), and at the butt end 11 of the racket 1. These portions of greater density may be achieved by adding higher density material to the racket composite material in these areas. For example, higher density portions can be achieved by adding rubber particles to the racket material in the higher density portions 11, 23, 25, and 27. The use of rubber provides the benefit of greater density, and thus increased weight, but does not significantly increase detrimental stiffness in the portions 11, 23, 25, and 27. The varying weight at one or more of the portions 11, 23, 25, and 27 may be achieved by alternative methods. For example, frame thickness variations and/or separate weights may be provided in one or more of the portions 11, 23, 25, and 27.

The disclosed tennis racket 1 may possess a relatively high swingweight, recoilweight, and twistweight, while also possessing a relatively low pickup weight. A high swingweight may be beneficial to a tennis player by allowing tennis racket 1 to generate more power.

High recoilweight and high twistweight of tennis racket 1 may contribute to increased stability of tennis racket 1. In particular, because tennis rackets are becoming lighter, they generate less momentum and absorb more shock and vibrations. When tennis racket 1 strikes a tennis ball, its motion is altered about both recoilweight axis 21 and longitudinal axis 17. As the magnitude of these motion forces after ball-strike about recoilweight axis 21 and longitudinal axis 17 increase, the amount of energy wasted increases. Therefore, the high swingweights and twistweights achieved by the various tennis rackets 1 of the present disclosure result in more efficient energy transfer from the player to the ball through the racket. That is, less force is wasted through vibration and deflection of tennis racket 1 as compared to rackets with lower swingweight and twistweight.

However, it may also be important for game play to have a racket with improved maneuverability. The pickup weight (PUW) characterizes the apparent weight of a tennis racket 1 sensed by a player while tennis racket 1 is held in a player's hand. A low pickup weight corresponds to a lower sensed weight, improving maneuverability of tennis racket 1. On the contrary, a high pickup weight corresponds to a higher sensed weight, reducing the maneuverability of tennis racket 1.

Because the tennis rackets of the present disclosure may possess a relatively high swingweight, recoilweight, and twistweight, while also possessing a relatively low pickup weight, tennis rackets 1 may exhibit improved power and stability characteristics while still maintaining desirable maneuverability. An improved tennis racket 1 of the present disclosure may have a Power Maneuverability Ratio from about 4500 to about 7915, a Stabilized Power Maneuverability Ratio from about 57,000 to about 115,000, and a Stabilized Maneuverability Ratio from about 211 to about 318.

It will be apparent to those skilled in the art that various modifications and variations can be made in the disclosed tennis racket without departing from the scope of the invention. Other embodiments of the invention will be apparent to those skilled in the art from consideration of the specification and practice of the invention disclosed herein. It is intended that the specification and examples be considered as exemplary only. The following disclosure identifies some other exemplary embodiments.

What is claimed is:

1. A tennis racket, comprising:
a handle with a butt end;
a head configured to support strings; and
a throat connecting the handle and the head;
wherein the racket has a Power Maneuverability Ratio greater than about 4500, the Power Maneuverability Ratio governed by the equation:

$$PMR = \frac{(SW)(RW)}{(PUW)},$$

where SW=the moment of inertia in kilogram-centimeters squared of the tennis racket about a swingweight axis that is perpendicular to a longitudinal axis of the tennis racket, parallel to a tennis ball hitting surface contained by the head, and intersecting a point on the handle that is four inches from the butt end along the longitudinal axis, $$RW = SW - \left(\frac{Wt}{1000}\right)\left(\frac{b}{10} - 10.16\right)^2,$$

Wt=the weight of the racket in grams, b=the distance in millimeters between a center of gravity of the racket to the butt end, TW=the moment of inertia of the tennis racket about the longitudinal axis, and PUW=(Wt)(b).

2. The tennis racket of claim 1, wherein the Power Maneuverability Ratio is from about 4500 to about 7915.

3. The tennis racket of claim 1, wherein a weight of the racket is from about 255 grams to about 348 grams.

4. The tennis racket of claim 1, wherein a balance distance from the butt end to the center of gravity of the racket is from about 300 mm to about 356 mm.

5. The tennis racket of claim 1, further including higher density portions of the head at 3, 9, and 12 o'clock positions.

6. The tennis racket of claim 5, further including a higher density portion of the racket at the butt end.

7. The tennis racket of claim 6, wherein the head includes a composite material and the higher density portions include rubber.

8. A tennis racket, comprising:
a handle with a butt end;
a head configured to support strings; and
a throat connecting the handle and the head;
wherein the racket has a Stabilized Power Maneuverability Ratio greater than about 57,000, the Stabilized Power Maneuverability Ratio governed by the equation:

$$SPMR = \frac{(SW)(RW)(TW)}{(PUW)},$$

where SW=the moment of inertia in kilogram-centimeters squared of the tennis racket about a swingweight axis that is perpendicular to a longitudinal axis of the tennis racket, parallel to a tennis ball hitting surface contained by the head, and intersecting a point on the handle that is four inches from the butt end along the longitudinal axis, $$RW = SW - \left(\frac{Wt}{1000}\right)\left(\frac{b}{10} - 10.16\right)^2,$$

Wt=the weight of the racket in grams, b=the distance in millimeters between a center of gravity of the racket to the butt end, TW=the moment of inertia of the tennis racket about the longitudinal axis, and PUW=(Wt)(b).

9. The tennis racket of claim 8, wherein the Stabilized Power Maneuverability Ratio is from about 57,000 to about 115,000.

10. The tennis racket of claim 8, wherein a weight of the racket is from about 255 grams to about 348 grams.

11. The tennis racket of claim 8, wherein a balance distance from the butt end to the center of gravity of the racket is from about 300 mm to about 356 mm.

12. The tennis racket of claim 8, further including higher density portions of the head at 3, 9, and 12 o'clock positions.

13. The tennis racket of claim 12, further including a higher density portion of the racket at the butt end.

14. The tennis racket of claim 13, wherein the head includes a composite material and the higher density portions include rubber.

15. A tennis racket, comprising:
a handle with a butt end;
a head configured to support strings; and
a throat connecting the handle and the head;
wherein the racket has a Stabilized Maneuverability Ratio greater than about 211, the Stabilized Maneuverability Ratio governed by the equation:

$$SPMR = \frac{(RW)(TW)}{(PUW)},\ RW = SW - \left(\frac{Wt}{1000}\right)\left(\frac{b}{10} - 10.16\right)^2,$$

SW=the moment of inertia in kilogram-centimeters squared of the tennis racket about a swingweight axis that is perpendicular to a longitudinal axis of the tennis racket, parallel to a tennis ball hitting surface contained by the head, and intersecting a point on the handle that is four inches from the butt end along the longitudinal axis, Wt=the weight of the racket in grams, b=the distance in millimeters between a center of gravity of the racket to the butt end, TW=the moment of inertia of the tennis racket about the longitudinal axis, and PUW=(Wt)(b).

16. The tennis racket of claim 15, wherein the Stabilized Maneuverability Ratio is from about 211 to about 318.

17. The tennis racket of claim 15, wherein a weight of the racket is from about 255 grams to about 348 grams.

18. The tennis racket of claim 15, wherein a balance distance from the butt end to the center of gravity of the racket is from about 300 mm to about 356 mm.

19. The tennis racket of claim 15, further including higher density portions of the head at 3, 9, and 12 o'clock positions.

20. The tennis racket of claim 19, further including a higher density portion of the racket at the butt end.

21. The tennis racket of claim 20, wherein the head includes a composite material and the higher density portions include rubber.

* * * * *